United States Patent [19]

Stylianou

[11] 4,438,846

[45] Mar. 27, 1984

[54] CASSETTE BOX CONSTRUCTION

[76] Inventor: Andreas S. Stylianou, 5595 Finch East, Scarborough Ontario, Canada, M1B 2T9

[21] Appl. No.: 406,364

[22] Filed: Aug. 9, 1982

[51] Int. Cl.[3] ..... B65D 5/50; B65D 25/10; B65D 25/54; B65D 55/02

[52] U.S. Cl. ..... 206/387; 206/45.31; 206/45.34; 206/807; 229/39 R

[58] Field of Search ..... 206/387, 807, 45.34, 206/45.31; 229/45, 39 R

[56] References Cited

U.S. PATENT DOCUMENTS

| | | | |
|---|---|---|---|
| 2,467,702 | 4/1949 | Smart | 229/45 |
| 2,730,231 | 1/1956 | Ryan | 229/17 B |
| 2,834,531 | 5/1958 | Struble | 206/807 |
| 3,037,684 | 6/1962 | Andrews et al. | 229/45 |
| 3,462,066 | 8/1969 | Farquhar | 206/807 |
| 3,587,837 | 6/1971 | Smith et al. | 206/45.34 |
| 3,656,612 | 4/1972 | Sellors | 206/387 |
| 3,675,763 | 7/1972 | Sandel | 206/387 |
| 3,682,297 | 8/1972 | Austin et al. | 206/387 |
| 3,871,516 | 3/1975 | Holkestad et al. | 206/45.31 |
| 3,949,931 | 4/1976 | Hall | 206/807 |

*Primary Examiner*—William T. Dixson, Jr.
*Attorney, Agent, or Firm*—Sim & McBurney

[57] ABSTRACT

There is provided a cassette support box having four wall panels to enclose a four-sided volume for receiving a tape cassette holder. One end of the box is closed by structure which includes an end panel hinged to a first wall panel, a tuck flap hinged to the end panel and adapted to be tucked inside a second wall panel opposite the first wall panel, the tuck flap and the end panel being joined along a hinge line which contains a slot, the second wall panel having a linking tab hinged thereto, and an entry tab hinged to the linking tab. The entry tab has a general width less than the length of the slot, but including a lateral protrusion which increases the width to greater than the length of the slot, thereby requiring a distorting force in order to insert the entry tab into the slot. In this manner, removal of the entry tab from the slot is discouraged. This design is intended to reduce theft.

11 Claims, 5 Drawing Figures

FIG. 2
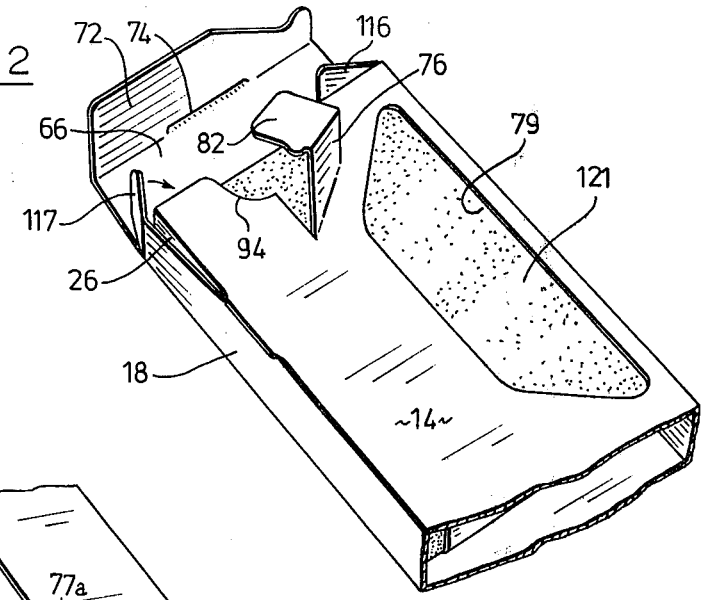
FIG. 4
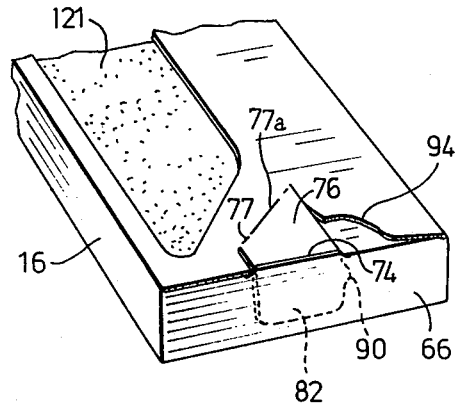
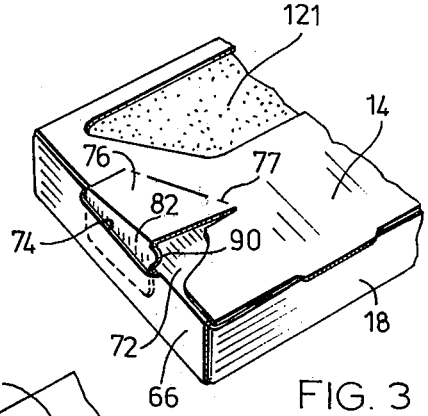
FIG. 3
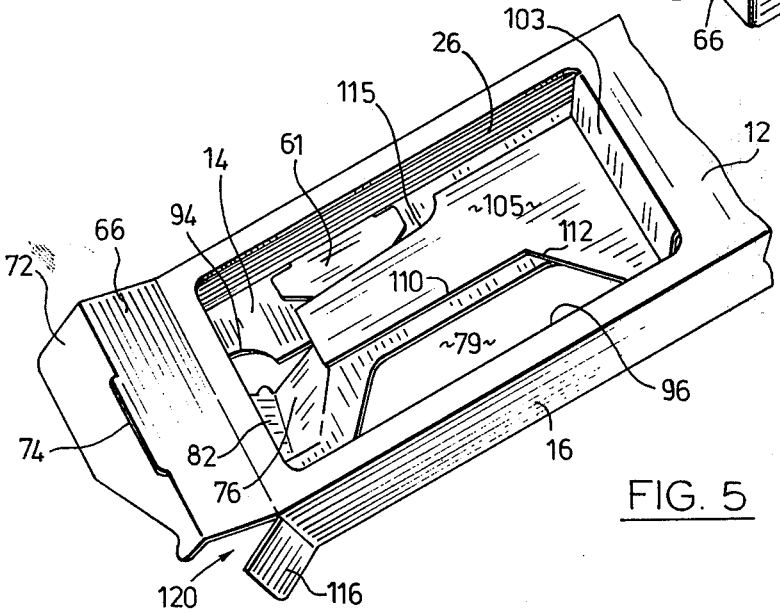
FIG. 5

CASSETTE BOX CONSTRUCTION

This invention relates generally to the tape cassette industry, and has to do particularly with a cassette box construction adapted to receive a cassette holder and to enclose the same in such a way that theft from the box is discouraged.

BACKGROUND OF THIS INVENTION

Since the introduction of tape cassettes several years ago, a number of display boxes have been developed to allow retail outlets to stock the tape cassettes in slotted installations previously used to hold L.P. records. Generally, these slots were up to six inches deep, and therefore some holder or box had to be devised to allow the tape cassettes to be held and displayed above the top of the record slots. The conventional solution has been to devise an elongated box holding the tape cassette in one end thereof, with suitable windows to show the face of the tape cassette, and with the lower part of the box empty and used merely for support. The support boxes are not sold with the tape cassettes, but instead are taken to the cashier who removes the tape cassette from the storage box, sells the cassette to the purchaser, and then returns the support box to a stockpile of empty such boxes waiting to be filled again with new tape cassettes for sale.

Because of the small size of the tape cassettes as compared to L.P. records, a growing problem of theft has been encountered by retail outlets. It is a simple matter for a person to open the support box while pretending to examine it, remove the tape cassette and slip it into a pocket or purse, and then replace the support box.

It is an aspect of this invention to provide a cassette support box which is equipped with means to discourage theft from it of a contained cassette tape, while nonetheless allowing the cashier readily to open the box.

Another aspect of this invention is to provide flap means integral with the box and adapted to maintain a cassette tape in proximity to the upper end of the box.

GENERAL DESCRIPTION OF THIS INVENTION

Accordingly, this invention provides an improvement in a box construction which includes an entry tab adapted to enter a slot. The improvement consists in providing, on the entry tab, a protrusion which is such as to make the width of the entry tab at the region of the protrusion greater than the width of the slot, thereby to require a distorting force to insert the entry tab into the slot, whereby removal of the entry tab from the slot is discouraged.

In another aspect, this invention provides a cassette support box which includes four wall panels adapted to enclose a four-sided volume for receiving a tape cassette holder. One end of the box is closed by an end panel hinged to a first wall panel. The first wall panel has an opening through which a face of the tape cassette holder is visible, the opening have a rectilinear edge remote from the end panel. Structure is provided to maintain a tape cassette holder in proximity to the end panel, this structure including a limit panel hingedly connected to the first wall panel at the rectilinear edge, and a backing panel hingedly connected to the limit panel remote from the rectilinear edge and adapted to lie between the second wall panel and the tape cassette holder.

GENERAL DESCRIPTION OF THE DRAWINGS

One embodiment of this invention is illustrated in the accompanying drawings, in which like numberals denote like parts throughout the several views, and in which:

FIGS. 2, 3 and 4 are sequential, perspective, partial views of the cassette support box during the set up procedure; and FIG. 5 is a perspective view of a portion of the cassette support box, taken from the opposite side as compared to FIG. 2.

DETAILED DESCRIPTION OF THE DRAWINGS

Figure 1:
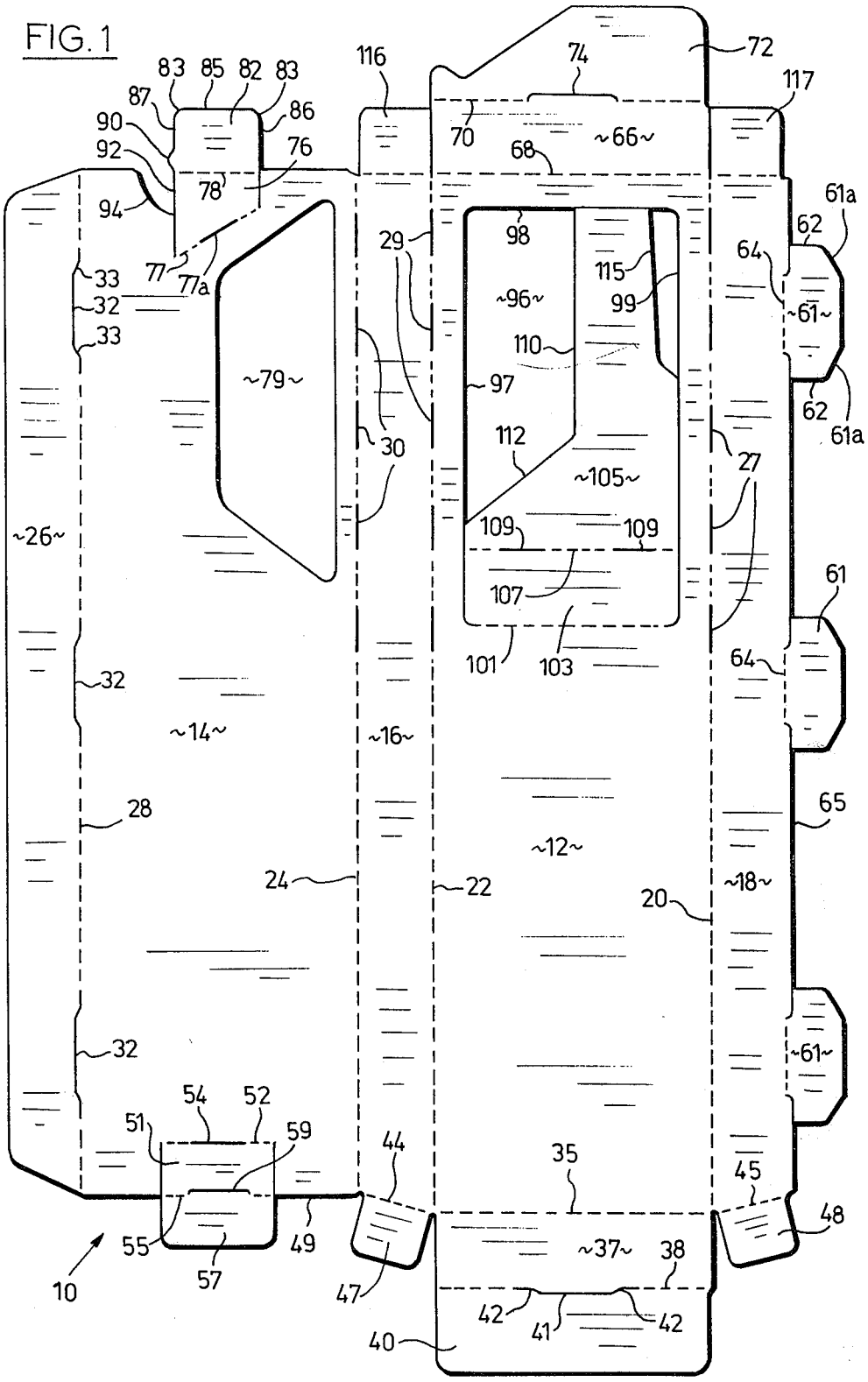
FIG. 1 is a view of a blank which can be set up to form a cassette box construction in accordance with this invention.

Attention is first directed to FIG. 1, which shows a blank 10 suitable for use in setting up a support box for a tape cassette. The box 10 includes a first wall panel 12, a second wall panel 14, a third wall panel 16 between the panels 12 and 14, and a fourth wall panel 18. The panels 14–18 are all substantially rectangular. Panel 12 is connected to panel 18 along a fold line 20, and is connected to panel 16 along a fold line 22. The panel 16 is in turn connected to the panel 14 along a fold line 24. Along its side opposite to the fold line 24, the panel 14 is connected hingedly to a flap 26.

Throughout the drawing of FIG. 1, fold lines are represented in broken lines, while outside edges and locations of severing are illustrated in solid line.

The fold line 20 contains a series of severed portions 27, while the fold lines 22 and 24 contain severed regions 29 and 30 respectively. The fold line 28 between the panel 14 and the flap 26 contains three slots 32 which contain offsets 33 for a purpose to be explained subsequently.

The panel 12 has a bottom edge 35 constituting a fold line between the panel 12 and a lower end panel 37. The end panel 37 is rectangular, and has an edge 38 opposite the fold line 35, the edge 38 constituting a further fold line interconnecting the end panel 37 with a tuck flap 40. The fold line 38 includes a severed portion 41 containing two offsets 42.

The bottoms of the two panels 16 and 18 are oblique, as can be seen in FIG. 1, and define fold lines 44 and 45, respectively, which constitute hinge lines between the panels 16 and 18 and side flaps 47 and 48, respectively, which are substantially rectangular, but with rounded outer corners. In the blank shown in FIG. 1, all flaps intended to enter slots or the like have either rounded or chamfered corners, as can be seen.

The panel 14 has a bottom edge 49 which is interrupted by the presence of a linking tab 51 hinged to the panel 14 along a fold line 52 which is offset inwardly of the bottom edge 49, and which contains a central severed region 54. The linking tab is substantially rectangular, and has an edge 55 opposite the fold line 52 which constitutes a fold line between the tab 51 and an entry tab 57. The fold line defined by the edge 55 has a central severed region 59.

Referring now to the panel 18, it will be seen that there are attached to this panel three tabs 61, each having chamfered corners 61*a*, and each having two "wings" 62 overhanging or cantilevered from a fold line 64 which is slightly offset inwardly from the outer edge 65 of the panel 18. It will be evident that the tabs 61 are intended to enter the slots 32. By the provision of the inward offset of the fold lines 64, together with the offsets 33 in the slots 32, the wings 62 of each tab 61 are trapped within the respective slot 32 because, once the tab 61 is in place in the slot, the wings 62 interfere with the portion of the flap 26 adjacent the extreme parts of the respective slot 33.

Referring now to the upper end of the blank shown in FIG. 1, means are providing for closing the upper end of the box, this means including an upper end panel 66 hinged to the first wall panel 12 along a hinge line 68 which constitutes the upper edge of the panel 12. The upper end panel 66 is substantially rectangular, and has an edge 70 opposite the hinge line 68, the edge 70 constituting a further fold line between the end panel 66 and a tuck flap 72. The tuck flap 72 is adapted to be tucked inside the second wall panel 14.

It will be noted that the hinge line 70 between the end panel 66 and the tuck flap 72 contains a slot 74 which has rounded ends and which is slightly offset upwardly (i.e. away from the panel 12) by comparison with the rest of the line 70.

The second wall panel 14 has a linking tab 76 hinged thereto along a fold line 77 having a central slot 77*a*. The fold line 77 is oblique in the embodiment shown, although this is primarily due to the presence of a substantially trapeziodal opening 79 which is provided to allow a view of one side of a cassette tape. (It is well known that cassette tapes are normally sold in protective plastic boxes or cases, but to avoid confusion with the box to which this specification is directed, the cassette cases will be referred to as 'holders' hereinafter.)

Hingedly connected to the linking tab 76 along a fold line 78 aligned with the upper edge 80 of the panel 14 is an entry tab 82 which is substantially rectangular in outline including an outer edge 85 and two side edges 86 and 87. The entry tab 82 departs from rectangularity by virtue of two outer rounded corners 83, and by virtue of a lateral, rounded protrusion 90 on the side 87 adjacent the fold line 78. Were it not for the protrusion 90, the width of the entry tab 82, i.e. the distance between the sides 86 and 87, would allow it easily to enter the slot 74 without mechanical interference and without requiring a distorting force to be applied. However, the presence of the protrusion 90 effectively increases the width of the entry tab 82 at that location so that it becomes greater than the width of the slot 74 by a small amount sufficient to require distorting force to be applied to cause the protrusion 90 to pass within the slot 74. Due to the presence of the protrusion 90, removal of the entry tab 82 from the slot 74 is discouraged, since it requires an equivalent distorting force to be applied in order to remove the entry tab 82. It is evident that, by adjusting the size, roundedness and location of the protrusion 90 and the thickness and material of the box itself, the degree of distorting force necessary to insert and remove the entry tab 82 from the slot 74 may be adjusted to any desired value. If desired, two protrusions may be applied, on the two sides 86 and 87.

In order to permit the cashier or other authorized personnel to insert a fingernail or thumbnail under the linking tab 76 in order to exert the requisite force for removing the entry tab 82 from the slot 74, a portion of the panel 14 is cut away adjacent the rightward edge 92 of the linking tab 76, leaving a rounded contour 94. In the assembled condition, the contour 94 will define a small region adjacent the linking tab 76, where a fingernail may be inserted under the linking tab 76, i.e. between the linking tab 76 and the adjacent tuck flap 72.

Attention is now directed to the panel 12, which is illustrated as containing a substantially rectangular opening 96, the purpose of which is to permit the front face of a tape cassette holder to be visible to the prospective customer. The opening 96 is defined by three edges 97, 98 and 99, and a fold line 101 which is rectilinear and which is remote from the end panel 66. Structure is provided to maintain a tape cassette holder in proximity to the end panel 66, and this structure includes a limit panel 103 hingedly connected to the first wall panel 12 along the fold line 101, and a backing panel 105 which is hingedly connected to the limit panel 103 at a fold line 107 which is on the other side of the limit panel 103 from the fold line 101. The fold 107 includes two severed regions 109.

As can be seen, the backing panel 105 is cut away along edges identified by the numerals 110 and 112, and these edges are intended to approximately align themselves with corresponding edges of the opening 79 in the panel 14, when the box is in its set-up condition. This will become more clear during the subsequent description of the other figures.

The backing panel 105 is also cut away at 115, in order to allow for the presence of the uppermost tab 61.

At the upper ends of the panels 16 and 18 are located side flaps 116 and 117, respectively, each of which is rectangular except for one rounded outer corner.

The severed regions 27, 29 and 30 are provided in their respective fold lines in order to weaken those fold lines adjacent the large openings 79 and 96. Without these severed regions, the material of the panels 12 and 14 would tend to 'pull up' away from the tape cassette holder, and lend an untidy appearance to the box. The severed regions 109 and the fold line 107 are provided to permit easy folding between these two portions.

Attention is now directed to FIG. 5, which shows the upper end portion of the box after tabs 61 have been inserted in the slots 32, but prior to the insertion of a tape cassette holder through the upper open end 120. Prior to such insertion, the backing panel 105 is pressed downwardly against the second wall panel 14 (the furthest from the viewer in FIG. 5). The cassette tape holder is then inserted against the limit panel 103, so that the backing panel 105 is trapped between the tape cassette holder and the wall panel 14. The opening 96 is of course of smaller width than the tape cassette holder, so that the holder is retained within the box.

To set up the bottom end of the box is a simple procedure which has not been illustrated. The steps include first folding the side flaps 47 and 48 inwardly, then inserting the flap 40 inside and against the panel 14 while the entry tab 57 is held away from interference, and then inserting the entry tab 57 through the severed portion 41. This is a well known set up procedure and does not require illustration.

Attention is now directed to FIG. 2, which shows the upper end of the box from the opposite perspective, with a tape cassette holder 121 in position. The tape cassette holder 121 has been stippled to distinguish it from portions of the box.

FIG. 2 shows that the first step in closing the upper end of the box is to fold in the flaps 116 and 117. Following that, the tuck flap 72 is inserted between the tape cassette holder 121 and the panel 14, while the entry tab 82 is held away out of an interfering position.

Next, as seen in FIG. 3, the entry tab 82 is inserted in the slot 74. FIG. 3 shows the entry tab 82 in a position just prior to passage of the protrusion 90 through the slot 74.

In FIG. 4, the entry tab is fully inserted, and the protrusion 90 lies to the inside of the slot 74.

It will be evident that the degree to which theft is discouraged will be somewhat dependent upon the resilience of the material utilized for the box. It is preferred that the material of the box be a resilient plastic selected from the group comprising: flame treated polyethylene or polypropylene plastic sheets varying in thickness from 0.010" to 0.050".

While a particular embodiment of this invention has been illustrated in the accompanying drawings and described hereinabove, those skilled in the art will appreciate that changes and modifications may be made therein without departing from the essence of this invention as set forth in the appended claims.

I claim:

1. In a box construction which includes an entry tab adapted to enter a slot, the entry tab having side edges and a leading edge, the improvement which comprises, on one side edge of the entry tab, a protrusion which merges smoothly with said one side edge in both directions, said protrusion being of a size such as to make the width of the entry tab at the region of the protrusion greater than the width of the slot, thereby to require a distorting force to insert the entry tab into the slot, whereby removal of the entry tab from the slot is discouraged.

2. The invention claimed in claim 1, in which the entry tab is hinged at a fold line to a linking tab, and in which the protrusion is situated adjacent the fold line.

3. The invention claimed in claim 1 or claim 2, in which the material of the entry tab and the material defining the slot are resilient.

4. A cassette support box comprising:

means defining four wall panels adapted to enclose a four-sided volume for receiving a tape cassette holder, and means closing one end of the box, said means including an end panel hinged to a first wall panel, a tuck flap hinged to said end panel and adapted to be tucked inside a second wall panel opposite said first wall panel, the tuck flap and the end panel being joined along a hinge line which contains a slot, the second wall panel having a linking tab hinged thereto, and an entry tab hinged to said linking tab, the entry tab having two side edges and having a general width between said side edges which is less than the length of said slot, the entry tab including a lateral protrusion on one side edge which merges smoothly with said one side edge in both directions, the protrusion increasing said width to greater than the length of said slot, thereby to require a distorting force to insert the entry tab into the slot, whereby removal of the entry tab from the slot is discouraged.

5. The invention claimed in claim 4, in which the material of the box is resilient.

6. The invention claimed in claim 4, in which the entry tab is substantially rectangular, with one side being a hinge location between the entry tab and the linking tab, the protrusion being rounded and being situated along a side of the entry tab which is adjacent said one side, whereby to minimize movement of said entry tab in said slot between a position in which the hinge location is coincident with said slot and a position in which the protrusion binds in said slot.

7. The invention claimed in claim 4 or claim 6, in which the box is made of a material selected from the group comprising: flame treated polyethylene or polypropylene plastic sheets varying in thickness from 0.01" to 0.050".

8. The invention claimed in claim 4, claim 5 or claim 6, in which said first wall panel has an opening through which a face of the tape cassette holder is visible, the opening having a rectilinear edge remote from said end panel, the cassette box further having a structure maintaining a tape cassette holder in proximity to said end panel, said structure including a limit panel hingedly connected to said first wall panel at said rectilinear edge, and a backing panel hingedly connected to said limit panel remote from said rectilinear edge and adapted to lie between said second wall panel and the tape cassette holder.

9. A cassette box comprising:

means defining four wall panels adapted to enclose a four-sided volume for receiving a tape cassette holder, means closing one end of the box, said means including an end panel hinged to a first wall panel, the first wall panel having an opening through which a face of the tape cassette holder is visible, the opening having a rectilinear edge remote from said end panel, the cassette box further having structure maintaining a tape cassette holder in proximity to said end panel, said structure including a limit panel hingedly connected to said first wall panel at said rectilinear edge, and a backing panel hingedly connected to said first limit panel remote from said rectilinear edge and adapted to lie between said second wall panel and the tape cassette holder.

10. The invention claimed in claim 9, in which the material of the box is resilient.

11. The invention claimed in claim 9, in which the box is made of a material selected from the group comprising: flame treated polyethylene or polypropylene plastic sheets varying in thickness from 0.010" to 0.050".

* * * * *